US007121935B2

(12) United States Patent
Pretorlus

(10) Patent No.: US 7,121,935 B2
(45) Date of Patent: Oct. 17, 2006

(54) BLADE SHARPENER

(76) Inventor: Stephan Deon Pretorlus, 24 Mossle Street, Newcastle 2940 (ZA)

( * ) Notice: Subject to any disclaimer, the term of this patent is extended or adjusted under 35 U.S.C. 154(b) by 0 days.

(21) Appl. No.: 10/499,888

(22) PCT Filed: Dec. 23, 2002

(86) PCT No.: PCT/ZA02/00219

§ 371 (c)(1),
(2), (4) Date: May 5, 2005

(87) PCT Pub. No.: WO03/055646

PCT Pub. Date: Jul. 10, 2003

(65) Prior Publication Data

US 2005/0217433 A1 Oct. 6, 2005

(30) Foreign Application Priority Data

Dec. 23, 2001 (ZA) ..... 2001/7222

(51) Int. Cl.
*B21K 5/12* (2006.01)

(52) U.S. Cl. ..... 451/321; 451/555; 451/556; 76/82; 76/88

(58) Field of Classification Search ..... 451/321, 451/322, 545, 555, 486, 556, 558, 522, 349, 451/540, 319; 76/82, 88, 86
See application file for complete search history.

(56) References Cited

U.S. PATENT DOCUMENTS

| | | | | |
|---|---|---|---|---|
| 1,894,579 | A * | 1/1933 | Blankner | 451/486 |
| 1,909,743 | A * | 5/1933 | Blankner | 451/486 |
| 4,674,356 | A * | 6/1987 | Kilgore | 74/570.2 |
| 5,440,953 | A * | 8/1995 | Gangelhoff et al. | 76/86 |

* cited by examiner

*Primary Examiner*—Jacob K. Ackun, Jr.
(74) *Attorney, Agent, or Firm*—Law Office of Marc D. Machtinger, Ltd.

(57) ABSTRACT

A blade sharpener (10) comprises sharpening strip providing carriers (12) and (14) each including an obliquely extending linear sharpening strip providing rod (16) and carrier movement non-interference guiding means in the form of a slot defining formation formed by facing rail pairs (18), (20) facing one another across a slot (22). The rail pairs (18) and (20) form part of a carrier support frame (24) to which the carriers (12), (14) are mounted to be displaced in diametrically opposed directions and along the spacings formed between the rails of the rail pairs (18), (20). A crossover point (28) is defined between the rods (16) within which the cutting edge of the blade of a knife is in an abrasion fashion moved during a sharpening action. The crossover point (28) is constrained to move along a linear sharpening path extending along the slot (22) during sharpener use. The carriers (12), (14) are biased by springs (26) to cause the return of the crossover point (28) to an inter strip commencement crossover position.

13 Claims, 4 Drawing Sheets

5(a)

5(b)

BLADE SHARPENER

BACKGROUND TO THE INVENTION

The manual sharpening of blades is a common actively. This can be achieved in a variety of ways including by way of the manual cyclical reciprocation of a blade in a notch or forked formation defined between sharpening elements. While such technique of sharpening is well known the precision sharpening of a blade is an often-desired activity amongst knife specialists. In this regard the maintenance of the primary edge underscoring faces of a blade ending in its cutting edge at a fixed angle during a sharpening routine is of primary importance. It is an object of this invention to address this requirement. While of particular use for sharpening the blades of knives the invention is not limited thereto but can be applied for sharpening any relevant type of blade.

1. Field of the Invention

This invention relates to a manually operable blade sharpener at least employable for the precision sharpening of a blade. Although not so limited the sharpener of the invention finds useful application in the field of the sharpening of knife blades.

2. Prior Art Description

Equipment for the manual sharpening of blades by way of the manual cyclical reciprocation of a blade in a notch or forked formation defined between sharpening elements is known in the art. U.S. Pat. Nos. 4,550,632 and 5,440,953 both define sharpening elements crossing one another in defining a sharpening notch. Both patents also present guiding means for guiding a blade into a sharpening notch. None of the these patents, however, address the situation of precision sharpening as their sharpening elements are swivellably mounted to a base that thus gives rise to a continuously changing sharpening angle in the performance of a sharpening routine. While the subject matter of U.S. Pat. No. 4,624,079 discloses sharpening elements that are mounted to maintain a fixed sharpening angle it does not present a guide path associated therewith. It also thus does not provide for the precision sharpening of a blade.

BRIEF DESCRIPTION OF THE DRAWING

The invention is now described, by way of example, with reference to the accompanying drawings. In the drawings

DETAILED DESCRIPTION OF THE DRAWINGS

Figure 1:
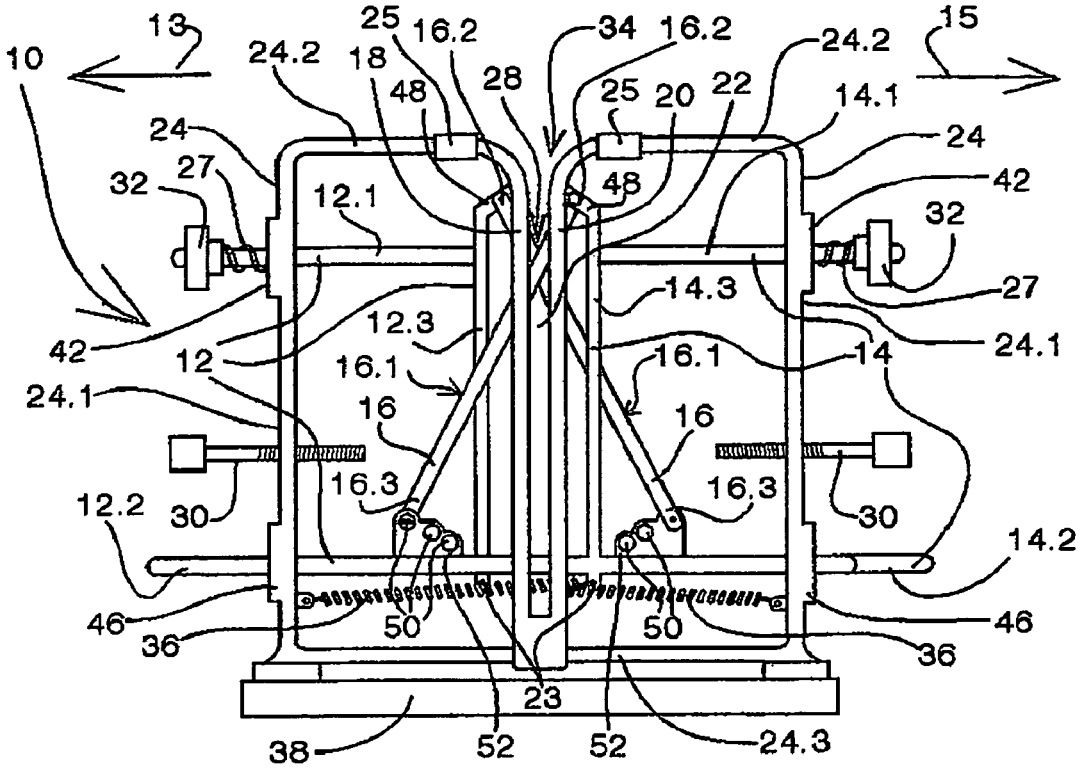
FIG. 1 shows a manually usable blade sharpener in the form of a knife blade sharpener, in side elevation.

Referring to FIGS. 1 to 5 of the drawings a blade sharpener in the form of a knife blade sharpener is generally indicated by reference numeral 10.

The sharpener 10 comprises two horizontally displaceably mounted sharpening strip providing carriers 12 and 14 respectively, each including an obliquely extending linear sharpening strip providing rod 16 and carrier movement non-interference guiding means in the form of a slot defining formation as providing a slot defining frame member layout formed by facing rail pairs 18, 20 facing one another across a slot 22. The rail pairs 18 and 20 form part of a carrier support frame 24 to which the carriers 12, 14 are mounted to be displaced in diametrically opposed directions once the sharpener 10 is used for blade sharpening purposes. The carrier 12 is thus mounted to be outwardly displaced in the direction of arrow 13 and the carrier 14 in the direction of arrow 15. The carriers 12, 14, as mounted in snug adjacent displacing relationship relative to one another, are mounted to be displaced along the spacings 26 formed between the rails 18.1, 18.2 and 20.1, 20.2 of the rail pairs 18, 20.

While the carriers 12, 14 are freely displaceably mounted their respective ranges of displacement are limited to cause the rods 16 to maintain a forked crossover relationship by forming a randomly displaceable crossover point 28 defining a cutting angle 17 within which the cutting edge of the blade of a knife is in an abrasion incurring way moved during a sharpening action. The location of the crossover point 28 is naturally dependent on the relative positioning of the carriers 12, 14 and thus the rods 16 but is limited to a uni-planar displacement in a plane parallel to the planes of displacement of the carriers 12, 14. While the crossover point 28 is randomly displaceable within the relative operative ranges of the carriers 12, 14, it is naturally constrained to move along a linear sharpening path extending along the slot 22 once the sharpener 10 is used for performing a blade sharpening action, as more fully discussed below.

The carriers 12, 14 are limited to their ranges of displacement by way of limiting means in the form of adjustable stops that are provided, as regards outward displacement, by stop screws 30 adjustably fitting though threaded apertures in the end sections 24.1 of the frame 24 that constrains outward displacement by coming to abut against frame members 12.3, 14.3 respectively. As regards inward displacement the limiting means is provided by nuts 32 fitting adjustably onto threaded ends of upper sliding arms 12.1, 14.1 forming part of the respective carriers 12, 14. To cause the return of the crossover point 28 to an inter-strip commencement crossover position in the region of the entrance to the slot 22 when not exposed to a sharpening action, the carriers 12, 14 are biased by biasing means in the form of springs 36 each extending between the appropriate end section 24.1 of the support frame 24 and a hook formation 23 formed on the relevant carrier 12, 14. To cushion inward displacement of the towards the nuts 32 as urged by the springs 36 when a blade is rapidly removed from the slot 22 the arms 12.1, 14.1 are fitted with cushioning springs 27. Although not shown the tensioning of the springs 36 can be adjustable by either replacement of springs of different tension or by providing a series of hook formations 23 for each spring.

The leading side surfaces 16.1 of the rods 16 are naturally abrasively formed for performing their combined abrasive sharpening effect once the sharpener 10 is in use.

Figure 2:
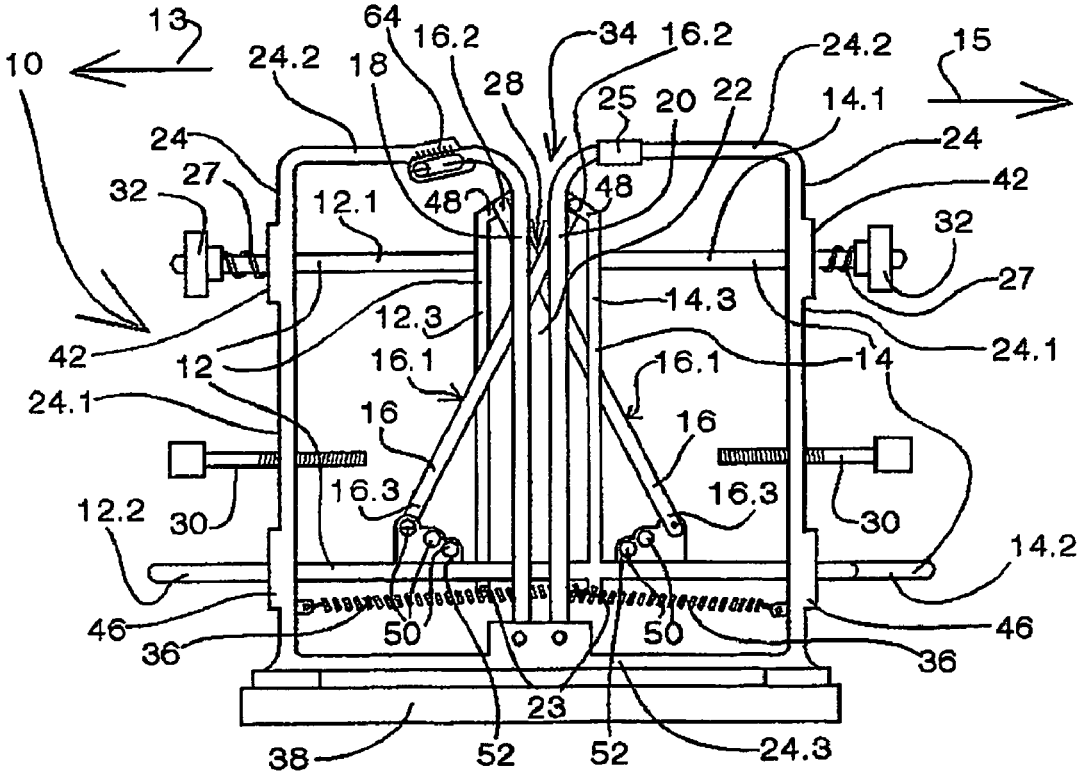
FIG. 2 shows the blade sharpener of FIG. 1 though with a modification as regards the ability to alter the slope of a blade-sharpening path defined along the sharpener.
Figure 3:
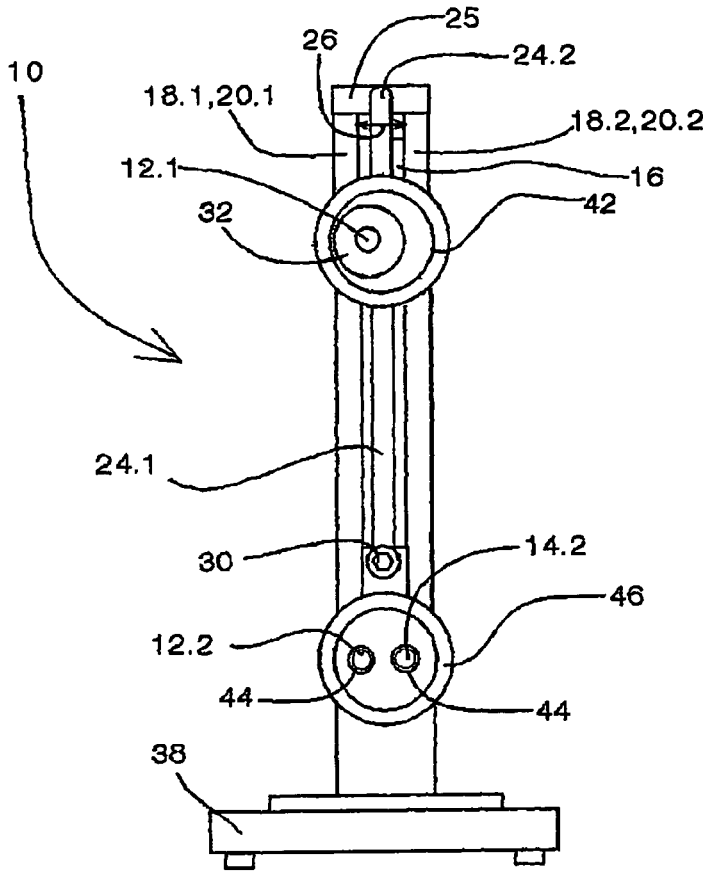
FIG. 3 shows the sharpener of both FIGS. 1 and 2 in end elevation.
Figure 4:
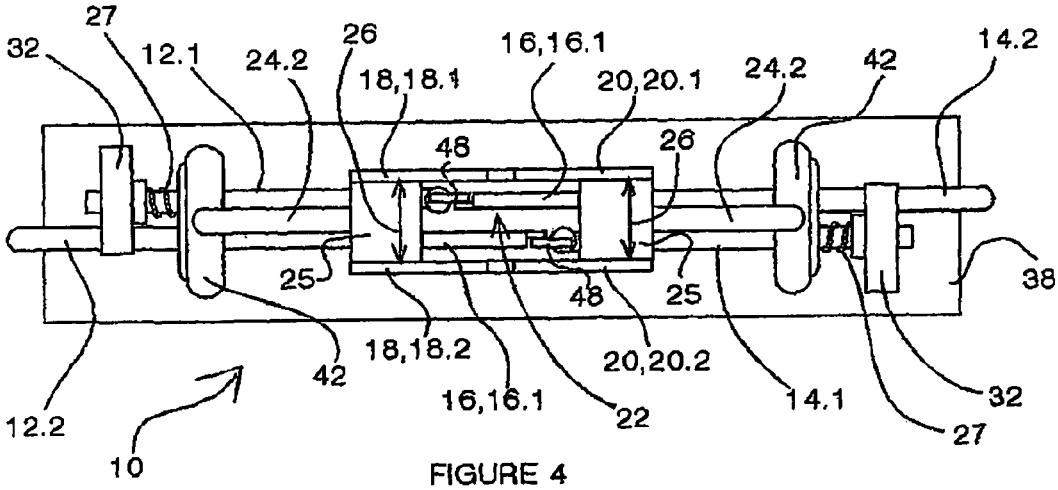
FIG. 4 shows the sharpener of the FIG. 1 in plan view, FIG. 5 stepwise shows the operation of the sharpener though omitting the modification as regards the ability to alter the slope of the blade sharpening path.

The support frame 24 is constituted from its ends frame sections 24.1 and overhead sections 24.2 running into rail pair securing formations 25 or adjustment means as shown in FIG. 2 for the modified sharpener 10 and discussed in more detail further on. The rail pairs 18, 20 in turn run from the formations 25 into a stand section 24.3 via which the frame 24 is anchored to a base 38 forming part of the sharpener 10. The rail pairs 18, 20 flare outward at the inlet 34 to the slot 22 to facilitate location of a blade into the slot 22.

The carriers 12, 14 are displaceably mounted to the support frame 24 via their upper sliding arms 12.1, 14.1 that pass slidably along apertures each formed at a high elevation through aperture blocks 42 forming part of the end sections 24.1 and lower sliding arms 12.2, 14.2 each supported at both ends in apertures 44 formed in aperture blocks 46 also forming part of the end sections 24.1. Each of the upper sliding arms 12.1, 14.1 is only supported in the end section side towards which it slides on the carriers 12, 14 being caused to slide more out of overlap with respect to one another.

To accommodate a variety of primary edge blade angles the carriers 12, 14 make provision for adjustment of the slopes of the rods 16 and thus of their sharpening surfaces 16.1. This is achieved by having the rods 16 swivellably mounted at their upper ends 16.2 to rod support carrier frame sections 48 while the lower end 16.3 of each rod 16 is releasably securable to one of a series of rod lower end positions of securing in the form of rod connecting apertures 50 that are suitably arcuately arranged to permit the registration and securing of a selected one of the apertures 50 with an aperture formed at the lower end of the rod 16. The apertures 50 are presented along aperture carriers 52 integrally formed above the lower sliding arms 12.2, 14.2.

Figure 5:
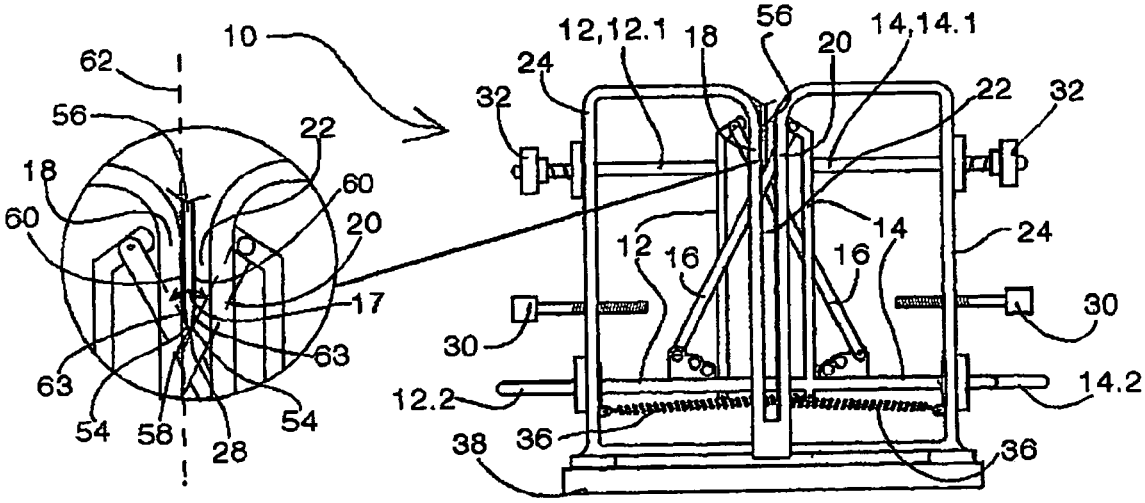
Figure 5:
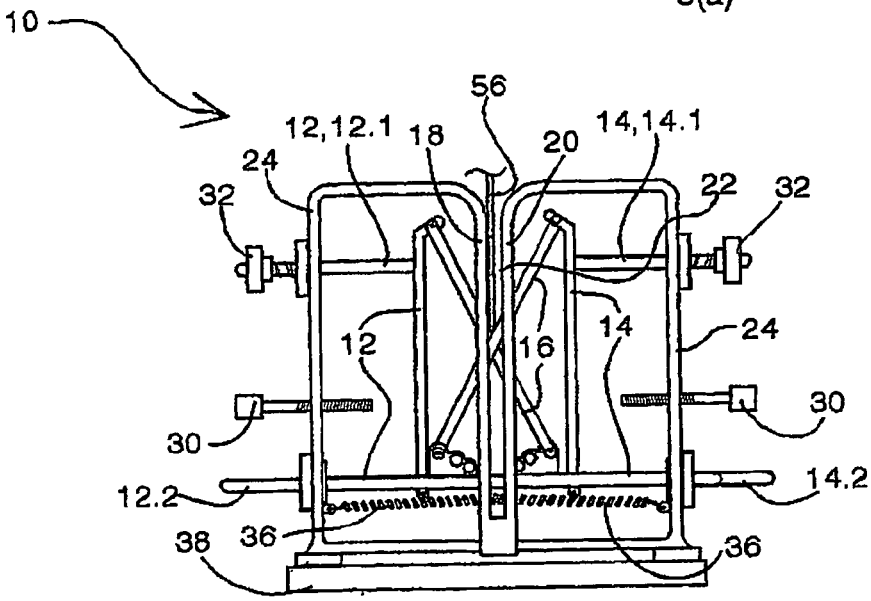

As shown in FIG. 5 the use of the sharpener 10 involves conventionally cyclically reciprocatingly moving the blade of a knife along the blade-sharpening path that extends down the slot 22. As the object of the sharpener 10 is to achieve precision sharpening of the cutting edge of a blade, the path does not necessarily extend centrally down the slot 22.

A typical blade for which the sharpener 10 is useful in performing a precision sharpening action comprises primary edge underscoring faces ending in its cutting edge. Trailingly as regards the width of the blade the next part of the side faces of a blade is found in the secondary faces that in turn lead onto the broad trailing side faces. The typical blade is normally symmetrically formed with precision sharpening of the blade with the sharpener 10 thus involving the primary edge underscoring faces.

Such precision sharpening involves maintaining the position of the primary edge angle underscoring faces 54 of a blade 56, as shown in the detail to FIG. 5(*a*), and as terminating in the cutting edge 58 of the blade 56, in a fixed and preferably symmetrical relationship with respect to the crossover point 28 throughout a cyclical and reciprocating blade sharpening action. This is achieved by maintaining the central plane through the blade 56 and consequently its broad side face areas 60, as trailing the secondary faces 63 in parallel with the central axis 62 down the slot 22. When the width of the blade 56, as defined between opposite face 60, is such that a snug but free displacement of the blade 56 along the slot can be achieved, the blade-sharpening path is naturally defined down the slot 22 as such. Cyclical to-and-fro reciprocation of the blade 56 along the slot 22 has the effect of maintaining the blade 56 in parallel with the axis 62 down the slot 22 in turn causing its primary edge angle underscoring faces 54 to maintain a fixed relationship relative to the crossover point 28.

When the blade width is however less than the width of the slot 22 the sharpening path is defined down one of the rail pairs 18, 20 in that the blade 56 is maintained against the appropriate rail pair 18, 20 during the sharpening action. This scenario is typically shown in FIG. 5. A manually applied cyclical reciprocating sharpening action has the effect of causing the blade 56 to move up and down the sharpening path and to and fro in the crossover point 28 according to FIGS. 5(*a*) to 5(*b*) with the crossover point 28 following the cutting edge 58 of the blade 56 owing to the biasing effect of the springs 36. As the crossover point 28 is freely uniplanary displaceable it automatically finds its position of blade sharpening edge bedding when the blade 56 is moved along its sharpening path.

A typical sharpening routine involves as first step the desirable setting of the slopes of the rods 16 and thus of their surfaces 16.1 as described above.

While blades are often constructed as explained above, other forms of blade design are also found. In again referring to FIG. 2 and also to FIG. 6 the modified sharpener also accommodates blades of which the broad side face areas do not extend in parallel with one another. Typically such broad side face areas run directly into their primary faces. Otherwise such blades may have secondary faces while the primary faces still extend in a non-parallel relationship with one another. To still achieve the desired sharpening action for such blades in maintaining their primary edge underscoring faces, as ending in their cutting edge, in the crossover point 28 during use of the sharper, provision is made for adjusting the slope of at least one of the rail pairs 18, 20. This is achieved by having the appropriate rail pair 18, 20 swivellably mounted in its root as found in its point of connection to the stand section 24.3, as shown in FIG. 2, while its remote end is adjustably secured to the overhead section 24.2 by way of an adjustment facility (not shown in detail) including locking means enabling the re-lockable adjustment of the slope of the appropriate rail pair 18, 20. As shown in FIG. 2 the position of adjustable locking to the overhead section 24.2 provides an indicating scale 64 for indicating the extent of adjustment of the rail pair 18, 20 relative to the vertical.

Figure 6:
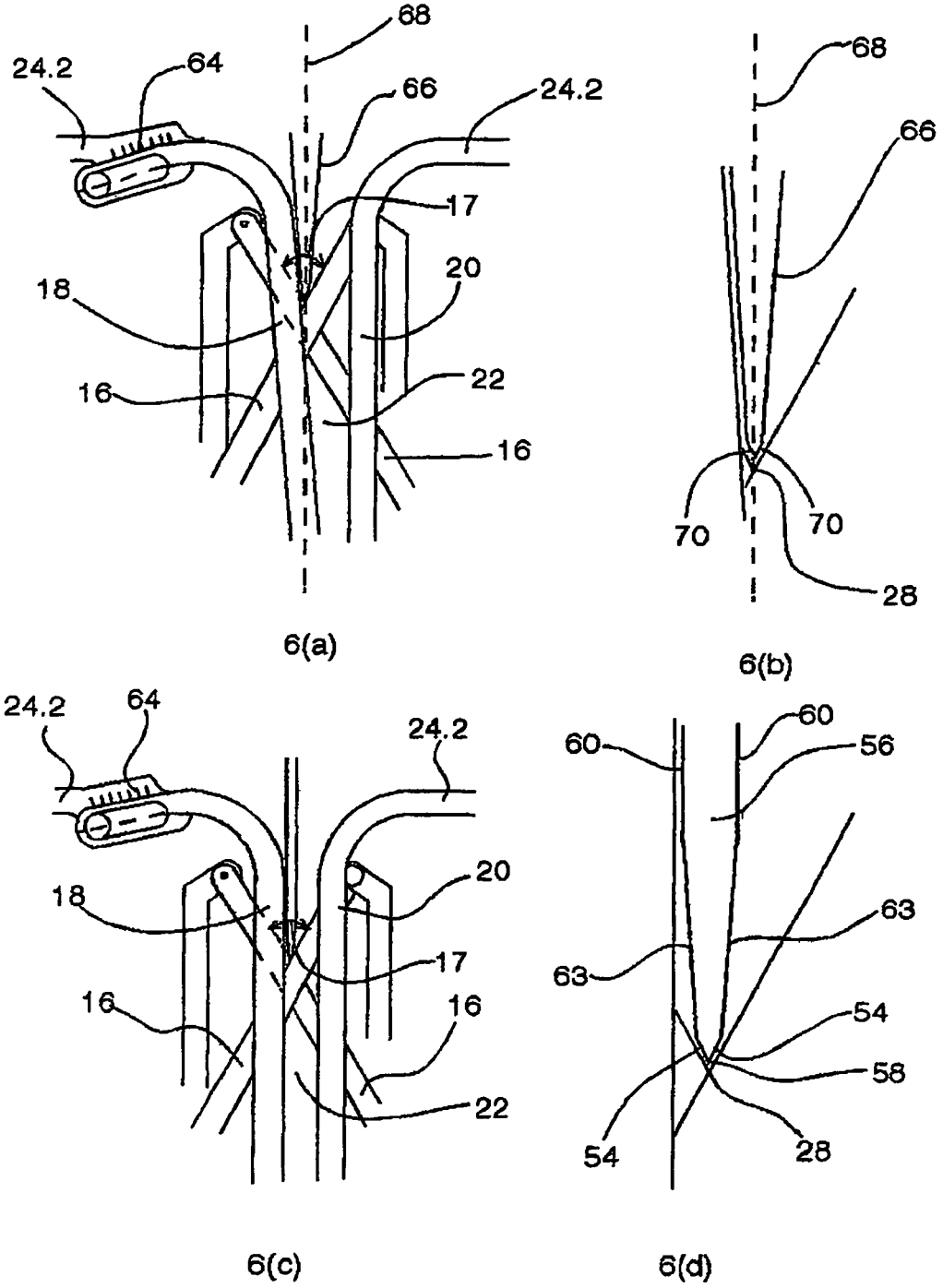
FIG. 6 shows in detail the operation of the sharpener as modified to also alter the slope of the blade-sharpening path.

Use of the FIG. 2 embodiment of the sharpener 10 in conjunction with a blade 64 of which the broad side areas are not parallel to one another involves desirably pre-setting of the slope of the relevant rail pair 18, 20 to the effect of ensuring that the centre line 66 of such blade 64, as shown in FIG. 6(*a*), is parallel to the vertical. The sharpening path is in this case defined along the rail pair 18, 20 of which the slope is suitably adjusted. This has the effect that the primary edge underscoring faces 68 still symmetrically fit the crossover point 28, as shown in more detail in FIG. 6(*b*).

A sharpening routine performed with the modified sharpener 10 of FIG. 2 of which the rail pair slope is appropriately adjusted can thus be performed with the same extent of precision, as is the case for a blade of which the broad side areas are parallel to one another, as discussed with reference to FIG. 5. As shown in FIGS. 6(*c*) and 6(*d*) the modified sharpener 10 can naturally also be used for blades having parallel broad side face areas. In such case the adjustable rail pair 18, 20 is simply adjusted to cause the rail pairs 18, 20 to extend parallel to one another thus effectively having a sharpener similar to that shown in FIGS. 1 and 5. As a blade used in conjunction with the FIGS. 6(*c*) and 6(*d*) embodiment is the same as that used in the FIGS. 1 and 5 embodiment it carries the same nomenclature.

Once a blade has been sharpened by means of the sharpening rods 16 the final step in its preparation is often its steeling. This is normally done at a blade cutting edge underscoring angle of larger that the angle of sharpening. If this step is required the sharpener 10 can simply be arranged to enable replacement of the rods 16 by steeling rods (not shown in detail but implied by the FIG. 2 embodiment of the invention). Alternatively while not shown the sharpener 10 can include steeling rods fitted with appropriately arranged clips that automatically define the desired increased underscoring angle once clipped to the rods 16.

The invention claimed is:

1. A manually usable blade sharpener at least employable for precision blade sharpening comprising at least two sharpening strip-providing carriers (12, 14) each presenting an abrasive sharpening strip (16.1) with the carriers (12,14), as mounted to be independently and linearly displaced towards and away from one another, being arranged and mounted to cause the sharpening strips (16.1), as crossing one another in defining a sharpening angle (17), to be displaced in adjacent planes to the effect of maintaining a fixed acute sharpening angle defining crossover relationship at a point of sharpening strip crossover (28) that is consequently uni-planarly movable in response to relative displacement of the carriers (12,14), biasing means (36) that biases the carriers to an inter-strip commencement crossover point defined at the one end of the range of displacement of the carriers (12, 14) relative to one another, limiting means (30, 32) defining the operative range of displacement of the carriers (12, 14) in maintaining the crossover relationship between the sharpening strips (16.1), and carrier movement non-interference guiding means (18, 20) defining a linear oath of blade traversal extending along the plane of movement of the sharpening strip crossover point (28), characterised by the guiding means (18, 20) defining in association with the route of crossover point displacement, as in turn associated with appropriate displacement of the carriers (12, 14) and that is brought about by the manually controlled displacement of a blade along the path of blade traversal once the sharpener (10) is in use, a blade sharpening path that extends from a point of blade insertion (34) associated with the inter-strip commencement crossover point, to a location associated with the end of the range of displacement of the carriers (12, 14) remote from the inter-strip commencement crossover point defining location, the sharpener (10) consequently at least enabling the precision sharpening of the cutting edge of such blade as formed at the confluence of its cutting faces, according to the sharpening angle (17), by way of the performance of a conventional reciprocating cyclic blade sharpening action along the blade sharpening path as thus involving the associated reciprocating cyclic movement of the crossover point (28).

2. A blade sharpener as claimed in claim 1 in which the carriers (12, 14) are mounted to be horizontally displaced once the sharpener (10) is in its use condition thus being displaceable in diametrically opposed directions during use of the sharpener (10).

3. A blade sharpener as claimed in claim 2 in which the limiting means (30, 32) that is involved in limiting the range of displacement of the carriers (12, 14) is in the form of adjustable stops that, one on the one hand, limit the extent of travel of the carriers (12, 14) in their outward and thus crossover point descent direction and, on the other hand, their extent of travel in their crossover point ascent direction of travel relative to one another into which latter direction of travel the carriers (12, 14) are biased by the biasing means (36).

4. A blade sharpener as claimed in claim 2 in which at least one of the carriers (12, 14) is arranged to enable the at least stepwise adjustment of the slope of its sharpening strip (16.1).

5. A blade sharpener as claimed in claim 2 in which the carriers (12, 14) are in the form of carrier frames each formed with a sharpening strip presenting rod (16) appropriately presenting its sharpening strip (16.1), adjustment of the slope of the appropriate sharpening strip (16.1), if not for both carriers (12, 14), where the carriers are so disposed, thus involving the adjustment of the slope of the relevant sharpening strip presenting rod (16).

6. A blade sharpener as claimed in claim 5 in which adjustment of the slope of the adjustable sharpening strip presenting rod (16), if not both rods and thus for each rod (16), is achieved owing to the rod (16) being swivellably mounted to the remainder of its carrier frame (12, 14) at an overhead position (16.2) while being securable at its remote end to the selected one of a series of suitably arcuately arranged rod lower end positions of securing (50) as forming part of the carrier frame.

7. A blade sharpener as claimed claim 2 that is arranged to cause the path of blade traversal to at least extend at least substantially vertical once the sharpener is operatively positioned.

8. A blade sharpener as claimed in claim 7 in which the guiding means (18, 20) is in the form a slot defining formation as opened at one end and which end forms the overhead position of entry into a slot (22), as thus defined by the formation, once the sharpener is operatively positioned with the position of entry consequently being associated with the inter-strip commencement crossover point while the blade sharpening path extends along at least one of the sides of the slot (22), against which side one of the side faces of a blade is urged during the performance of a sharpening action for maintaining it at a constant slope relative to the sharpening angle of the sharpener trough in the case of a snug blade fit down the slot in at least which case the slot defining formation extends along a uniform width, the path being defined along the slot as such, the sharpener also being employable for less precise sharpening of a non-snug-fitting blade by a way of conventional cyclical to and fro movement in the slot without necessarily urging one of its side faces against one of the sides" of the slot.

9. A blade sharpener as claimed in claim 8 in which the slot defining formation forms part of a carrier support frame (24) as displaceably mounting the carriers (12, 14), the support frame consequently including the slot defining formation in the form of a slot defining frame member layout that is shaped to present an overhead entrance to the slot that promotes the ease of location of a blade intended to be sharpened towards the blade sharpening path.

10. A blade sharpener as claimed in claim 9 in which the slot defining frame member layout is in the form of facing rail pairs of which each pair defines the side of the slot (22) with the rail pairs facing one another across the slot while being formed with progressively flaring upper ends to accommodate blade entry into the slot (22), the carriers (12, 14) being mounted to the carrier support frame (24) to result in their being displaceable between the rails of the rail pairs resulting in the blade sharpening path being defined in the intermediate zone found between the various rails of the rail pairs.

11. A blade sharpener as claimed in claim 10 in which the carriers are each mounted to the support frame byway of an upper and lower sliding arm (12.1, 12.2, 14.1, 14.2) of which the lower sliding arm (12.2, 14.2) serving as carrier base, snugly slidably engages with apertures in opposite ends of the support frame (24) while the upper sliding aim (12.1, 14.1) engages with an aperture in the end of the frame (24) towards which the relevant carrier is displaced on crossover point descent as perceived with the sharpener as positioned for use.

12. A blade sharpener as claimed in claim 8 in which the slot defining formation makes provision for adjusting the slope of at least one of its slot defining sides in a way that gives rise to a slot entry broadening action for accommodating the precision sharpening of a blade of which the side faces do not lie in parallel with one another; adjustability in the case of the slot defining formation being formed by the slot defining frame member layout being provided for by the part of the layout that forms at least one of the sides of the slot being swivellably mounted in its root to a lower location on the stationary part of the carrier support frame for re-lockably altering the slope of this part of the layout by way of locking means situated remote from its root position that is arranged to enable its releasable and adjustable locking to an overhead section of the stationary part of the carrier support frame.

13. A blade sharpener as claimed in claim 12 that includes an indicating scale (64) for indicating the extent of adjustment of the slope of the adjustable slot defining side of the slot defining formation, when formed by a slot defining frame member layout of which the one side is swivelably mounted in its root the indicating scale thus being presented in conjunction with the locking means.

* * * * *

UNITED STATES PATENT AND TRADEMARK OFFICE

CERTIFICATE OF CORRECTION

PATENT NO. : 7,121,935 B2
APPLICATION NO. : 10/499888
DATED : October 17, 2006
INVENTOR(S) : Pretorius It is certified that error appears in the above-identified patent and that said Letters Patent is hereby corrected as shown below:

Item (12) please delete "Pretorlus" and insert --Pretorius--

Item (76) please delete "Stephen Deon Pretorlus" and insert --Stephen Deon Pretorius--

Signed and Sealed this

Twenty-fifth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 7,121,935 B2
APPLICATION NO. : 10/499888
DATED : October 17, 2006
INVENTOR(S) : Pretorius It is certified that error appears in the above-identified patent and that said Letters Patent is hereby corrected as shown below:

Item (12) please delete "Pretorlus" and insert --Pretorius--

Item (76) please delete "Stephen Deon Pretorlus" and insert --Stephan Deon Pretorius--

This certificate supersedes the Certificate of Correction issued March 25, 2008.

Signed and Sealed this

Twenty-ninth Day of April, 2008

JON W. DUDAS
*Director of the United States Patent and Trademark Office*